United States Patent [19]

Lefferts

[11] Patent Number: 4,575,472

[45] Date of Patent: Mar. 11, 1986

[54] DOUBLE HELIX, SPIRAL BELTS MADE THEREFROM

[75] Inventor: Johannes Lefferts, Enschede, Netherlands

[73] Assignee: SITEG Siebtechnik GmbH, Fed. Rep. of Germany

[21] Appl. No.: 577,764

[22] Filed: Feb. 7, 1984

[30] Foreign Application Priority Data

Feb. 9, 1983 [DE] Fed. Rep. of Germany ..... 3304459

[51] Int. Cl.[4] ..... B32B 5/00; D04H 3/02

[52] U.S. Cl. ..... 428/222; 245/6; 428/98; 428/371

[58] Field of Search ..... 245/6; 428/98, 222, 428/371

[56] References Cited

U.S. PATENT DOCUMENTS

| | | | |
|---|---|---|---|
| 1,773,426 | 8/1930 | Haiss | 245/6 |
| 1,850,859 | 3/1932 | Woodman | 245/6 |
| 4,345,730 | 8/1982 | Leuvelink | 428/222 |
| 4,346,138 | 8/1982 | Lefferts | 428/222 |
| 4,392,902 | 7/1983 | Lefferts | 428/222 |

*Primary Examiner*—Marion C. McCamish

*Attorney, Agent, or Firm*—John J. Torrente

[57] ABSTRACT

Double helices each comprising two helix elements made from plastic wire with the longitudinal axes of the two helix elements extending in parallel and with the windings of the two helix elements intertwined, the double helices being formed by winding two plastic wires in parallel and without twist on a mandrel and being used to assemble a spiral belt by interengaging in zipper fashion a multiplicity of helices via meshing the windings of one helix with the windings of the next helix, and by inserting a pintle wire into the passage formed by the overlapping windings.

2 Claims, 7 Drawing Figures

FIG. 1
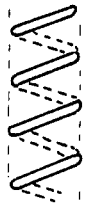
FIG. 2
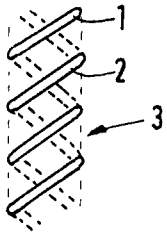
FIG. 3
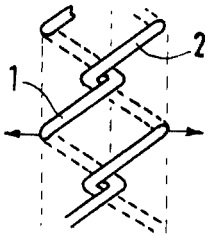
FIG. 5
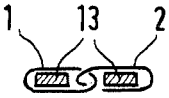
FIG. 4
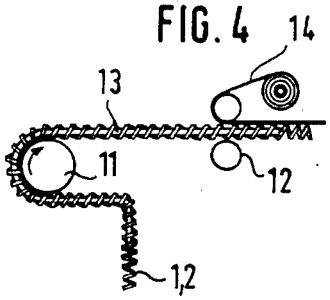
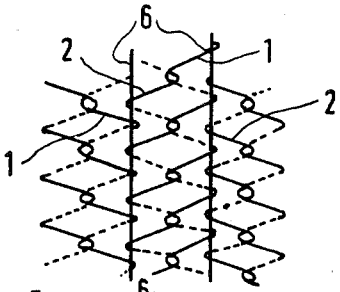
FIG. 6
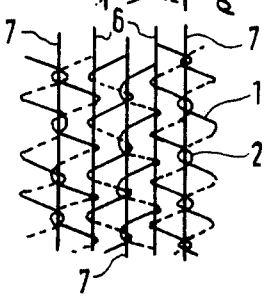
FIG. 7

DOUBLE HELIX, SPIRAL BELTS MADE THEREFROM

BACKGROUND OF THE INVENTION

The invention relates to a double helix comprising two helix elements made of plastic wire with the longitudinal axes of the two helix elements extending in parallel, to the production of such helices in which two plastic wires are wound on a mandrel, and to the use of the double helices to produce a spiral belt of the type wherein the helices are engaged with their windings in zipper fashion and are secured by a pintle wire.

Spiral belts comprised of helices are used as conveyor belts and as papermachine clothing. The costs involved in the manufacture of such belts are highly dependent on the production costs of the helices. Likewise, the production capacity of the belts depends primarily on that of the helices. In general, the production capacity of a machine assembling the helices to form a spiral belt is so high that a great number of helix producing machines operating at maximum speed are required to feed the assembling machine. Therefore, to minimize the helix production costs, it is essential that the output of the individual helix making machines be maximized.

The capacity of a helix producing machine can be increased by winding double helices instead of a single helix element. A double helix and a method for producing same are known from German Auslegeschrift No. 2,003,344. In this method, the two helix elements of the double helix are readily separated by laterally pulling the helices apart. This is accomplished by a complicated method in which the two helix wires are wound on a mandrel so as to alternately cross each other. Owing to these crossings, however, the helices have an asymmetrical cross section which makes them unsuited for the assembly of spiral belts having a smooth surface. Moreover, this reference fails to describe how the helices can be further processed to form a screen belt. Double helices have also been known from European patent application No. 18200. However, the double helices disclosed in this application are used with their longitudinal axes congruent i.e., without lateral displacement.

Spiral belts assembled from a multiplicity of helices in which the windings of the individual helices are intertwined are disclosed in German Pat. Nos. 54,525, 77,147 and 80,763. In these belts, pintle wires can be additionally inserted between the entwined windings. However, assembly of these belts from single helix structures requires that each new helix be screwed into the preceding helix. Such spiral belts are thus far more expensive to produce than are the spiral belts disclosed, for example, in German OS No. 2,938,221 where the helices mesh normal to their longitudinal axes and are secured in position by pintle wires.

It is therefore a primary object of the present invention to reduce the overall costs of producing spiral belts by reducing the cost factor of helix production.

SUMMARY OF THE INVENTION

In accordance with the principles of the present invention, the above and other objectives are realized in a double helix comprising two helix elements with intertwined windings and by producing such a double helix by applying two plastic wires in parallel on a mandrel. In making double helices in accordance with the invention, it is preferable that the two plastic wires are wound closely so that each helix element has a pitch equal to twice the diameter of the plastic wire.

In a further aspect of the invention, such double helices are used to assemble a screen belt by mutually offseting the helix elements of each double helix normal to their longitudinal axes and securing these elements in offset position. The secured elements are then assembled to form a screen belt substantially in the same manner as single helix structures and are interconnected by pintle wires.

In yet a further aspect of the invention, spiral belts are produced from double helices by separating the double helices into individual helices by rotating one about the other while retaining their orientation. The helices are then assembled into a spiral belt in the same manner as single helix structures.

A primary advantage attainable by the present invention is an increase in the capacity of helix winding machines. Furthermore, conventional helix winding machines can be adapted to produce double helices in a simple way.

When using a double helix in accordance with the invention to form a spiral belt, the two helix elements of the double helix are mutually offset normal to their longitudinal axes with their windings intertwined. If the two helix elements were left unrestrained in the offset condition, they would immediately slip back to form a double helix. Therefore, in accordance with the invention, the offset position of the helix elements is maintained by securing the elements in these positions. Preferably this is accomplished by using an adhesive tape.

Mutual offsetting of the helix elements may be effected by guiding the helices over two wires contained within the hollow spaces of the helix elements. In order to prevent the wires from being carried along by the helices they may be of curved configuration, e.g., U-shaped. By using rollers to engage the outside of the helix elements especially in the concave portions of their curved regions, the wires are prevented from being carried along by the advancing helix elements and slide within the hollow interiors thereof. Before the helix elements leave the wires the adhesive tape may be applied.

The two offset helix elements of the double helix can be assembled with other like helices to form a spiral belt in the customary way by intermeshing adjacent windings and inserting a pintle into the passage thereby formed. Thereafter the assembled belt may be thermoset as described in German Offenlegungsschrift No. 2,938,221. The temperature and the tension exerted on the belt by such processing are such that the windings of the helices penetrate into the material of the pintle wires leaving to some extent undular deformation therein. The helices are positioned closely side by side without any tension spring-like bias so that the wavelength of the undular pintle wire is about equal to twice the diameter of the plastic wire of the helices.

A spiral belt so formed has openings of different widths, which may be undesirable for use as clothing for papermaking machines. This can be largely eliminated by inserting a pintle wire between the intertwined windings of the helix elements of the double helix. The windings of the helix elements engage this pintle wire at the same place in the longitudinal direction of the pintle wire and only on opposite sides thereof so that this pintle wire will not be undularly deformed during thermosetting.

A further method of processing double helices to form a spiral belt in accordance with the invention comprises separating each double helix into two individual non-coherent helices. To this end, the two helix elements of the double helix are rotated to perform a circular motion one about the other while the orientation of the helix elements is maintained. Surprisingly the double helix thereby separates into two separate single helices. If the rotated helix elements are to be used to form a spiral belt for use as papermachine clothing, it is advantageous that the helix elements have a pitch equal to twice the wire thickness. This prevents the occurrence of any tension spring-like bias prior to thermosetting during assembly.

The method of separating each double helix into two separate single helices in accordance with the invention is very simple and can, therefore, be carried out at high speed. A single separator can thus process the output of several helix forming machines so that the cost savings of the invention are largely retained.

The method of the invention can generally be applied to multiple helices. Thus, for instance, three plastic wires can be wound side by side in parallel on a winding mandrel. The triple helix can then be separated into three individual helices by rotating the three helix elements about a common center while maintaining their orientation. Each of the three helices then has a pitch equal to thrice the wire thickness.

BRIEF DESCRIPTION OF THE DRAWINGS

The above and other features and aspects of the present invention will become more apparent upon reading the following detailed description in conjunction with the accompanying drawings, in which:

FIG. 1 shows a helix in accordance with the prior art;

FIG. 2 shows a double helix comprising two helix elements;

FIG. 3 illustrates a double helix with two mutually offset helix elements;

FIG. 4 shows a device for mutually offsetting the two helix elements of a double helix;

FIG. 5 is a section through the two helix elements of FIG. 4 passing over wires; and FIGS. 6 and 7 show spiral belts composed of double helices.

DETAILED DESCRIPTION

FIG. 1 shows a prior art helix. The pitch of the helix is depicted as greater than it actually is in the helices used for the assembly of screen or spiral belts. Normally, such helices have a pitch equal to the wire diameter or up to twice the wire diameter at the most.

FIG. 2 shows a double helix 3 comprising two intertwined helix elements 1, 2. In the helices shown in FIGS. 1 and 2 the spacing of the windings is equal. In the double helix, each helix element 1 and 2, taken by itself, has twice the pitch and the pitch angle is accordingly wider. As a consequence, double helices cannot be assembled into a spiral belt in the same way as single helices. On account of the greater pitch angle of the windings, intermeshed double helices immediately slip apart. i.e., they separate spontaneously and do not permit the insertion of a pintle wire. Hence, double helices would have to be held together by suitable means in order that a pintle wire can be inserted. However, this would complicate the method for producing the spiral belt to such an extent as to offset any reduction in costs attained by an increase in capacity of the helix forming machines. It has to be borne in mind that for assembly a double helix would first have to be pulled apart so far that the windings are spaced apart a distance at least equal to the wire diameter. Each helix element 1, 2 would thus have to have a pitch equal to four times the wire diameter.

FIG. 3 illustrates a double helix 3 in which the two helix elements 1 and 2, respectively, are mutually offset so that the windings thereof intertwine. Two such double helices can be intermeshed because each of the offset helix elements 1 or 2, respectively, has a pitch equal to only twice the wire diameter. In the production thereof the double helix can be wound without leaving any space between windings, i.e., side by side. However, if the elements 1 and 2 are merely offset without doing more, the two helix elements 1, 2 immediately slip together again, i.e., they assume the position shown in FIG. 2 in which the longitudinal axes of the helix elements 1, 2 coincide. This occurs as soon as the forces laterally offsetting the helix elements are eliminated.

FIG. 4 shows an apparatus for laterally offsetting the helix elements 1, 2 and for securing them in their offset positions. The apparatus includes a roll or roller 11 and a pair of rolls 12 driven at equal peripheral speeds. Two U-shaped stiff wires 13 are spaced about the roll 11 and through the gap of the roll pair 12. Each helix element 1 and 2, respectively, moves onto one of the two wires 13 so that the helix elements 1, 2 are pulled apart normal to the longitudinal axes thereof whereby two helix elements with intertwining windings are obtained. This method is comparable to that described in German application No. P 32 20 517.1.

The helix elements are advanced by means of the roll 11 and are pushed over the U-shaped wires 13. The rolls are arranged and the form of the wires 13 is selected so that the wires 13 cannot be carried along by the advancing helices.

FIG. 5 shows a section through the offset helix elements 1, 2 moving on the wires 13. The cross section of the wires is adapted, as to shape and dimension, to fit the free space within the coherent helix elements.

In this laterally offset state, an adhesive tape 14 is introduced into the nip of the roll pair 12 and is applied on the two helix elements 1, 2. The adhesive tape 14 prevents the helix elements 1, 2 from slipping one into the other again. The helix elements provided with the adhesive tape are then deposited in a can and can be readily assembled to form a screen belt without any difficulty and in the same manner as single helices. After assembly and insertion of the pintle wires the adhesive tape can then be removed.

As is apparent, the device of FIG. 4 for laterally offsetting helix elements and securing the elements in the offset position is of simple construction and permits a high operation speed so that the double helices produced by about ten helix winding machines can be processed by a single offsetting device. Also the removal of the adhesive tape is simple and does not cause any appreciable expense.

FIG. 6 shows a section of a spiral belt assembled from double helices with offset helix elements. As can be seen, the windings of each helix element of a double helix mesh with the windings of the helix element of the next following double helix, and through the passage formed by the overlapping region of the windings of the two helix elements a pintle wire 6 is inserted. On account of the different size of the openings remaining between the helix elements, the permeability of the spiral belt shown in FIG. 6 is not uniform. Therefore, it may sometimes be advantageous to insert additional pintle wires 7 between the entwined windings of the helix elements 1, 2 of a double helix as shown in FIG. 7. This substantially increases the uniformity of the spiral belt permeability.

Another method of using double helices in the assembly of a spiral belt is to disassemble the double helix into two single helices. A double helix can be separated into two single helices relatively simply by causing one helix element of a double helix to perform a circular motion about the other one while both helix elements retain their directional orientaion. Each one of the resulting single helices has a pitch equal to twice the wire thickness.

The latter described method can also be carried out at high speed so that it does not add any substantial costs.

The single helices obtained in this way can be assembled into a spiral belt in the conventional way, and the structure of the resultant spiral belt corresponds to that described in German OS No. 2,938,221.

In all cases it is understood that the above-identified arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A spiral belt comprising a multiplicity of double helices, each double helix containing two helix elements formed of windings and having longitudinal axes, the two helix elements of each double helix having their windings intertwinded and being mutually offset normal to their longitudinal axes, the windings of one of the helix elements of a double helix meshing in zipper fashion with the windings of a helix element of the preceding double helix and the windings of the other of the helix elements of the double helix meshing in zipper fashion with the windings of a helix element of the succeeding double helix, and a pintle wire being inserted into the passage formed in the overlapping region of each set of meshed windings.

2. A spiral belt according to claim 1 wherein the helix elements of each double helix are mutually offset only so much that their overlapping windings form a passage and a pintle wire is inserted into said passage.

* * * * *